US007333098B2

(12) United States Patent
Kobayashi

(10) Patent No.: US 7,333,098 B2
(45) Date of Patent: Feb. 19, 2008

(54) ACTIVE MATRIX DISPLAY APPARATUS AND METHOD FOR IMPROVED UNIFORMITY

(75) Inventor: Hiroshi Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 631 days.

(21) Appl. No.: 10/820,048

(22) Filed: Apr. 8, 2004

(65) Prior Publication Data

US 2004/0257350 A1 Dec. 23, 2004

(30) Foreign Application Priority Data

Apr. 8, 2003 (JP) ..... 2003-103763

(51) Int. Cl.
*G09G 5/00* (2006.01)

(52) U.S. Cl. ..... 345/204; 345/87; 345/98; 365/185.01; 365/185.18; 349/37

(58) Field of Classification Search ..... 345/87, 345/98, 94, 204; 365/185.01, 185.18, 185.25; 349/37

See application file for complete search history.

(56) References Cited

U.S. PATENT DOCUMENTS

| | | | | |
|---|---|---|---|---|
| 6,266,039 | B1 * | 7/2001 | Aoki | 345/94 |
| 6,282,136 | B1 * | 8/2001 | Sakurai et al. | 365/203 |
| 6,307,681 | B1 * | 10/2001 | Aoki et al. | 359/645 |
| 6,359,608 | B1 * | 3/2002 | Lebrun et al. | 345/100 |
| 6,563,743 | B2 * | 5/2003 | Hanzawa et al. | 365/189.02 |
| 6,924,784 | B1 * | 8/2005 | Yeo et al. | 345/98 |
| 2002/0011984 | A1 * | 1/2002 | Shirochi et al. | 345/96 |

FOREIGN PATENT DOCUMENTS

| | | |
|---|---|---|
| JP | 7-191624 | 7/1995 |
| JP | 8-286639 | 11/1996 |
| JP | 10-171421 | 6/1998 |
| JP | 11-218738 | 8/1999 |
| JP | 2000-267616 | 9/2000 |
| JP | 2001-228831 | 8/2001 |

* cited by examiner

*Primary Examiner*—Amare Mengistu
*Assistant Examiner*—Grant D. Sitta
(74) *Attorney, Agent, or Firm*—Oblon, Spivak, McClelland, Maier & Neustadt, P.C.

(57) ABSTRACT

An active matrix display apparatus is disclosed which can achieve significant improvement in uniformity. The display apparatus uses a horizontal driving circuit to which a pre-charge function is provided additionally. The horizontal driving circuit applies double sampling pulses including first and second pulses to each sampling switch. The first pulse is used to precharge a signal line with an image signal, and the second pulse is used to sample the image signal to the signal line. Where the second pulse of double sampling pulses applied to a preceding sampling switch and the first pulse of double sampling pulses applied to a succeeding sampling switch are in a temporally overlapping relationship with each other, image lines of different systems from each other are connected to the preceding sampling switch and the succeeding sampling switch thereby to prevent otherwise possible interference of the image signal between the two sampling switches.

5 Claims, 7 Drawing Sheets

CONVENTIONAL ART FIG. 5A
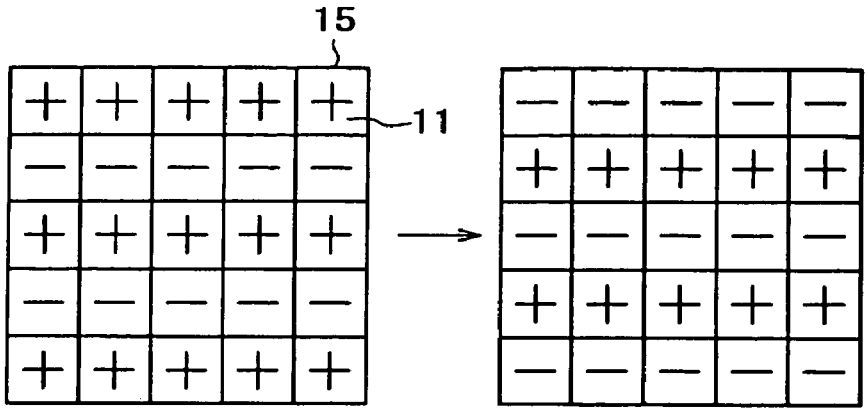
CONVENTIONAL ART FIG. 5B
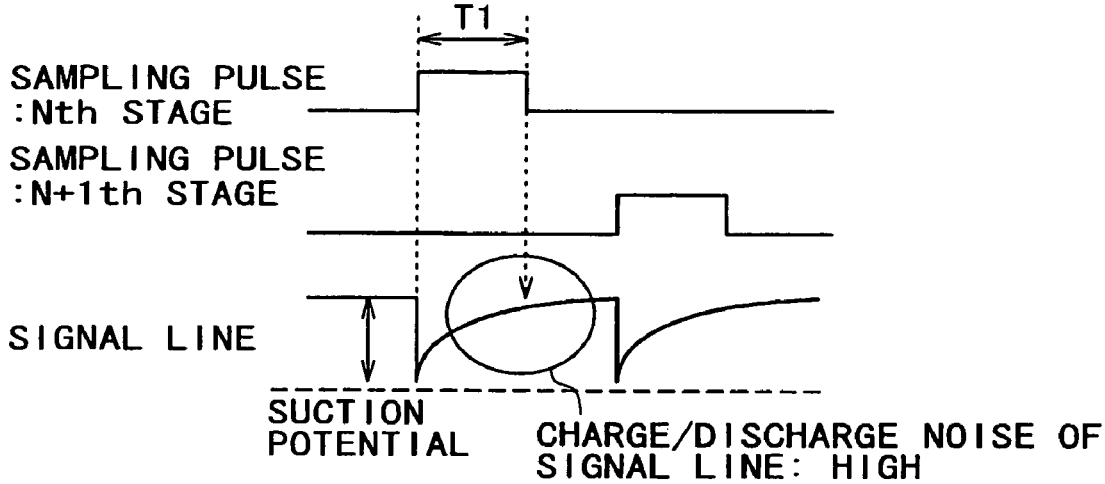

ACTIVE MATRIX DISPLAY APPARATUS AND METHOD FOR IMPROVED UNIFORMITY

BACKGROUND OF THE INVENTION

This invention relates to a display apparatus, and more particularly to improvements in or relating to a horizontal driving circuit built in an active matrix display apparatus of the dot-sequential driving type.

A related-art display apparatus typically has such a configuration as shown in FIG. 7. Referring to FIG. 7, the related-art display apparatus shown includes a panel 33 in which a pixel array section 15, a vertical driving circuit 16, a horizontal driving circuit 17 and other necessary circuits not shown are formed in an integrated manner. The pixel array section 15 includes gate lines 13 extending along rows, signal lines 12 extending along columns and pixels 11 disposed in rows and columns at intersecting points of the gate lines 13 and the signal lines 12. The vertical driving circuit 16 is disposed divisionally on the opposite left and right sides of the pixel array section 15 and connected to the opposite ends of the gate lines 13 to successively select the rows of the pixels 11. The horizontal driving circuit 17 is connected to the signal lines 12 and operates in response to a clock signal of a predetermined period to successively write an image signal into the pixels 11 of the selected row. The related-art display apparatus further includes an external clock production circuit 18 which generates clock signals HCK and HCKX which are used as a reference to operation of the horizontal driving circuit 17 and clock signals DCK1 and DCK2 having an equal period to but having a lower duty ratio than those of the clock signals HCK and HCKX. It is to be noted that the clock signal HCKX is an inverted signal of the clock signal HCK. Further, though not described particularly herein, also inverted signals DCK1X and DCK2X of the clock signals DCK1 and DCK2 are supplied as occasion demands. The external clock production circuit 18 supplies the clock signals and a horizontal start pulse HST to the panel 33 side. It is to be noted that a precharge circuit 20 is connected to the signal lines 12 such that it performs precharge of the signal lines 12 preceding to writing of an image signal to improve the picture quality.

[Patent Document 1] Japanese Patent Laid-open No. Hei 8-286639

[Patent Document 2] Japanese Patent Laid-open No. Hei 7-295520

The horizontal driving circuit 17 is connected to the signal lines 12 and operates in response to the clock signals mentioned hereinabove to successively write an image signal into the pixels 11 of the selected row. More particularly, the horizontal driving circuit 17 successively samples an image signal supplied thereto from the outside and holds the sampled signals to the signal lines 12. In the sampling and holding process of the image signal, charge and discharge occur with each of the signal lines 12, and noise is generated thereby. The charge and discharge noise has such a bad influence that a display defect in the form of a vertical stripe appears along the direction of a column of the pixel array section 15. Such a display defect in the form of a vertical stripe as just mentioned which arises from charge and/or discharge noise of a signal line is hereinafter referred to sometimes as "vertical stripe" In order to suppress a vertical stripe, conventionally a precharge circuit 20 is built in the panel 33. The precharge circuit 20 precharges the signal lines 12 prior to sample holding of an image signal to suppress generation of charge and/or discharge noise. The precharge improves the picture quality such as the uniformity of the screen.

With the related-art precharge of signal lines for which a precharge circuit is used, however, a vertical stripe cannot always be removed fully, and further improvement in the uniformity is demanded. Further, where the precharge circuit is built in the panel, increase of the area of the circuit board as much cannot be avoided, and this is not preferable from the point of view of the yield. In addition, the provision of the precharge circuit separately from the horizontal driving circuit unfavorably increases the cost.

SUMMARY OF THE INVENTION

It is an object of the present invention to provide an active matrix display apparatus which can achieve significant improvement in uniformity.

In order to attain the object described above, according to the present invention, a novel precharging function is additionally provided to a horizontal driving circuit. More particularly, according to an aspect of the present invention, there is provided a display apparatus including a panel including a plurality of gate lines extending along rows, a plurality of signal lines extending along columns, a plurality of pixels arranged in a matrix at intersecting points at which the gate lines and the signal lines intersect with each other, and a plurality of image lines separated into a plurality of systems for supplying an image signal, a vertical driving circuit connected to the gate lines for successively selecting the rows of the pixels, a plurality of sampling switches disposed for connecting the signal lines to the image lines, and a horizontal driving circuit operable in response to a clock signal for successively generating sampling pulses to successively drive the sampling switches so that the image signal is successively written into the pixels of the selected row, the horizontal driving circuit applying double sampling pulses including a first pulse and a second pulse to each of the sampling switches such that the corresponding signal line is precharged with the image signal in response to the first pulse and then the image signal is sampled to the signal line in response to the second pulse, the image lines being connected such that, where the second pulse of double sampling pulses applied to a preceding one of the sampling switches and the first pulse of double sampling pulses applied to a succeeding one of the sampling switches are in a temporarily overlapping relationship with each other, different ones of the image lines are connected to the preceding sampling switch and the succeeding sampling switch thereby to prevent interference of the image signal between the two sampling switches.

Preferably, the horizontal driving circuit includes a shift register for receiving a clock signal having a predetermined period and a start pulse having a pulse width equal to twice the predetermined period and performing a shifting operation of the start pulse in synchronism with the clock signal to successively output shift pulses from individual shift stages thereof and an extraction switch set for extracting a clock signal having the same period as that of the clock signal having a predetermined period in response to the shift pulses successively outputted from the shift register to successively produce the double sampling pulses.

Preferably, the image line of a first system is connected to those of the sampling switches which belong to a first group in which the sampling switches are disposed at every third place and the image line of a second system is connected to those of the sampling switches displaced by a one-switch distance from the sampling switches of the first group while the image line of a third system is connected to those of the sampling switches of the remaining third group thereby to prevent interference of the image signal between the preceding sampling switch and the succeeding sampling switch.

According to another aspect of the present invention, there is provided a driving method of a display apparatus which includes a panel including a plurality of gate lines extending along rows, a plurality of signal lines extending along columns, a plurality of pixels arranged in a matrix at intersecting points at which the gate lines and the signal lines intersect with each other, and a plurality of image lines separated into a plurality of systems for supplying an image signal, a vertical driving circuit connected to the gate lines for successively selecting the rows of the pixels, a plurality of sampling switches disposed for connecting the signal lines to the image lines, and a horizontal driving circuit operable in response to a clock signal for successively generating sampling pulses to successively drive the sampling switches so that the image signal is successively written into the pixels of the selected row, comprising a step executed by the horizontal driving circuit of applying double sampling pulses including a first pulse and a second pulse to each of the sampling switches such that the corresponding signal line is precharged with the image signal in response to the first pulse and then the image signal is sampled to the signal line in response to the second pulse, and a step of connecting, where the second pulse of double sampling pulses applied to a preceding one of the sampling switches and the first pulse of double sampling pulses applied to a succeeding one of the sampling switches are in a temporarily overlapping relationship with each other, different ones of the image lines to the preceding sampling switch and the succeeding sampling switch thereby to prevent interference of the image signal between the two sampling switches.

In the display apparatus and the driving method of a display apparatus, the horizontal driving circuit successively outputs double sampling pulses. The first pulse included in the double sampling pulses is provided with a precharge function while the second pulse is provided with an original sample holding function. In other words, the first pulse samples the image signal and supplies it to the signal line to precharge the signal line. Consequently, the potential of the signal line endlessly approaches the potential of the image signal to be written in originally. Then, the image signal is sampled with the second pulse and held to the signal line charged already. Consequently, when the original image signal is sample held, charge and discharge noise are generated little, and improvement against a vertical stripe can be achieved significantly. Further, the preceding and succeeding sampling switches whose sampling operations then partially overlap with each other are connected to the image lines of different systems from each other. Consequently, otherwise possible interference of the image signal between the two sampling switches is prevented. By the configuration described, the uniformity can be improved sufficiently by the horizontal driving circuit without provision of a separate precharge circuit.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIGS. 5A and 5B are diagrammatic views illustrating a writing procedure of an image signal;

DETAILED DESCRIPTION OF THE PREFERRED EMBODIMENT

Figure 1:
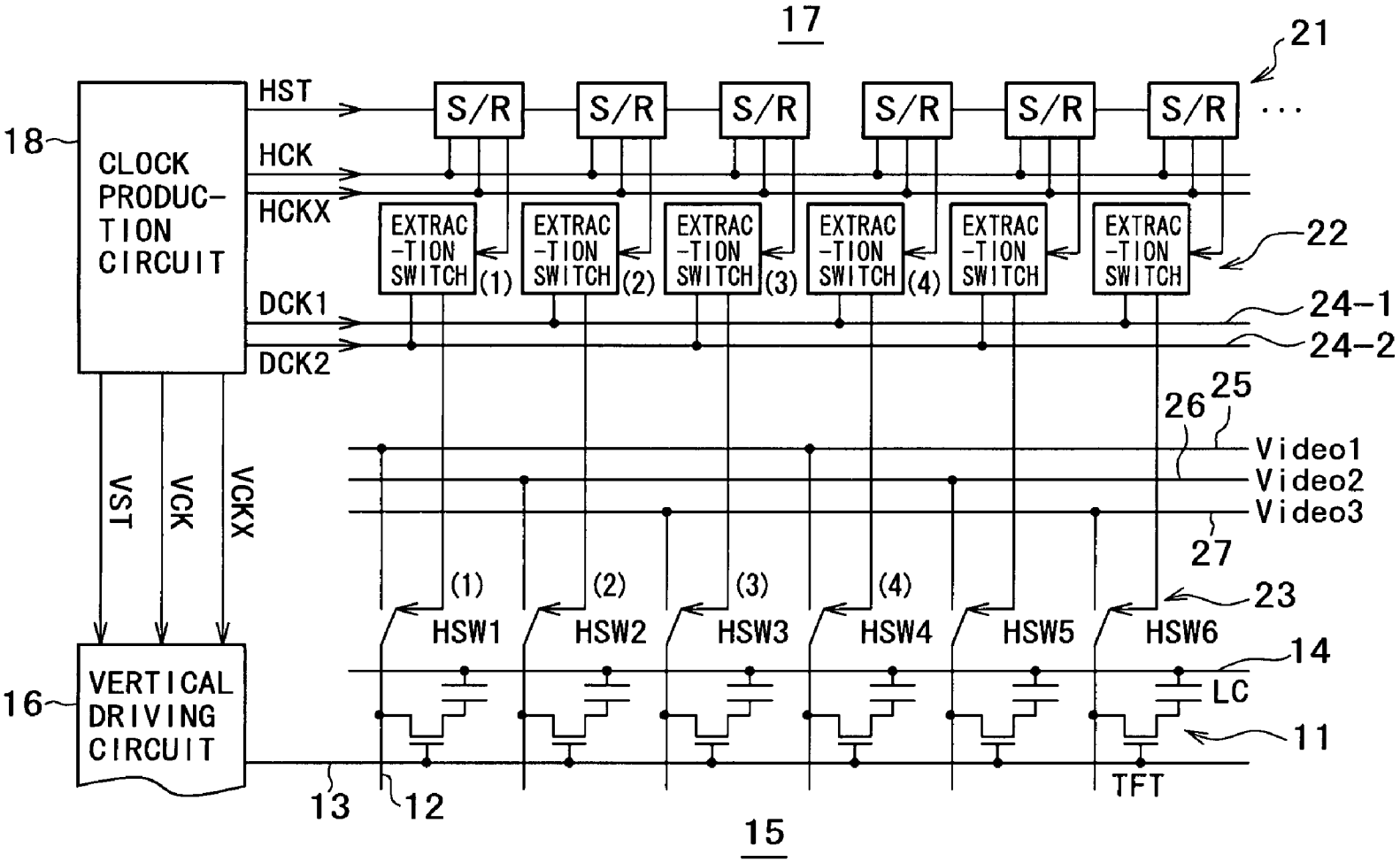
FIG. 1 is a block diagram showing a display apparatus to which the present invention is applied.

Referring to FIG. 1, there is shown a display apparatus to which the present invention is applied. The display apparatus shown includes a pixel array section 15, a vertical driving circuit 16 and a horizontal driving circuit 17 all formed in an integrated relationship on a single panel not shown. Also a sampling switch set 23 including a plurality of sampling switches HSW and image lines 25, 26 and 27 of plural systems are disposed on the panel. A clock production circuit 18 produces and supplies various clock signals and timing signals necessary for operation of the panel. The clock and timing signals include a horizontal start pulse HST, horizontal clock signals HCK and HCKX, clock signals DCK1 and DCK2, a vertical start pulse VST and vertical clock signals VCK and VCKX.

The pixel array section 15 includes gate lines 13 extending along rows, signal lines 12 extending along columns, pixels 11 disposed in rows and columns at intersecting points of the gate lines 13 and the signal lines 12, and other necessary elements. Each of the pixels 11 includes a liquid crystal cell LC and a thin film transistor TFT. One of electrodes of the liquid crystal cell LC is connected to the drain electrode of the thin film transistor TFT. The other electrode of the liquid crystal cell LC is connected to an opposing electrode 14. The source electrode of the thin film transistor TFT is connected to a signal line 12 while the gate electrode of the thin film transistor TFT is connected to a gate line 13. The vertical driving circuit 16 is connected to the gate lines 13 and selects a row of the pixels 11. More particularly, the vertical driving circuit 16 operates in response to the vertical clock signals VCK and VCKX supplied thereto from the clock production circuit 18 to successively transfer the vertical start pulse VST similarly supplied thereto from the clock production circuit 18 to successively output selection pulses to the gate lines 13. Consequently, the thin film transistors TFT on the selected gate line 13 are rendered conducting to allow writing of an image signal into the liquid crystal cells LC. The sampling switches HSW of the sampling switch set 23 are disposed to connect the signal lines 12 extending along the columns to the image lines 25, 26 and 27. As described above, the image lines 25, 26 and 27 supply an image signal separately in plural systems. The horizontal driving circuit 17 operates in response to the clock signals HCK and HCKX to successively transfer the horizontal start pulse HST to generate sampling pulses to successively drive the sampling switches HSW. Consequently, image signals Video1, Video2 and Video3 are successively sampled from the image lines 25, 26 and 27 to the signal lines 12, and the image signals are successively written into the pixels 11 of the selected row.

The horizontal driving circuit 17 applies double sampling pulses including first and second pulses to each of the sampling switches HSW. The first pulse precharges a signal line 12 with an image signal Video (Video1, Video2 or Video3), and then the second pulse samples the image signal Video in an overlapping relationship to the same signal line 12. Here, where the second pulse of double sampling pulses applied to the preceding sampling switch HSW1 and the first pulse of double sampling pulses applied to the succeeding sampling switch HSW3 are in a temporally overlapping relationship, the preceding sampling switch HSW1 and the succeeding sampling switch HSW3 are connected to the image lines 25 and 27 of different systems from each other thereby to prevent otherwise possible interference between image signals of the sampling switches HSW1 and HSW3.

In the present embodiment, the horizontal driving circuit 17 includes a shift register 21 formed from a plurality of shift stages (S/R) connected in series and an extraction switch set 22. The shift register 21 receives the clock signals HCK and HCKX having a predetermined period and the start pulse HST having a pulse width equal to twice the predetermined period and performs a shifting operation of the start pulse HST in synchronism with the clock signals HCK and HCKX to successively output shift pulses from the shift stages (S/R). The extraction switch set 22 extracts clock signals DCK1 and DCK2 having a period equal to that of the clock signals HCK and HCKX in response to the shift pulses (transfer pulses) (1), (2), (3) and (4) successively outputted from the shift register 21 to successively produce double sampling pulses (1), (2), (3) and (4). It is to be noted that the clock signals DCK1 and DCK2 are supplied to the extraction switches (clock signal extraction circuits) of the extraction switch set 22 through transmission lines 24-1 and 24-2 provided separately from the clock signals HCK and HCKX.

In the present embodiment, the sampling switches HSW of the sampling switch set 23 are grouped into a first group (HSW1 and HSW4), a second group (HSW2 and HSW5) and a third group (HSW3 and HSW6). The image line 25 of the first system is connected to the sampling switches HSW1 and HSW4 of the first group disposed at every third place. The image line 26 of the second system is connected to the sampling switches HSW2 and HSW5 of the second group displaced by a one-switch distance from the sampling switches HSW1 and HSW4, respectively. The image line 27 of the third system is connected to the sampling switches HSW3 and HSW6 of the remaining third group. In this manner, image lines of different systems are connected to each adjacent sampling switches to prevent otherwise possible interference between image signals of the preceding sampling switch and the succeeding sampling switch.

Figure 2:
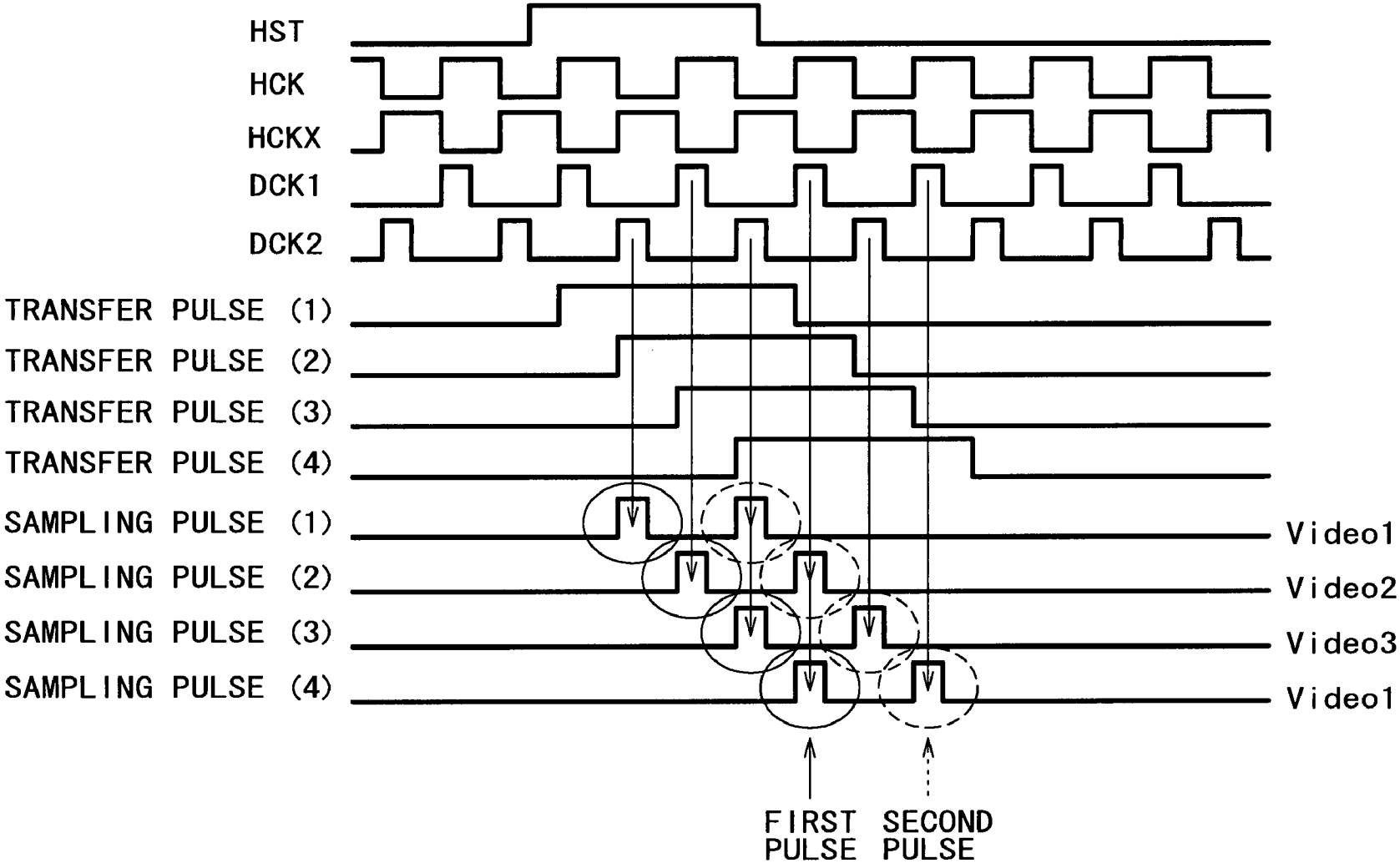
FIG. 2 is a timing chart illustrating operation of the display apparatus of FIG. 1.

FIG. 2 is a timing chart illustrating operation of the display apparatus of FIG. 1. Referring to FIG. 2, the clock signals HCK and HCKX supplied to the shift register are rectangular pulses having phases displaced by 180 degrees from each other and having a duty ratio of 50%. The horizontal start pulse HST has a pulse width equal to twice the period of the clock signal HCK and hence set equal to twice that in the related-art apparatus. As the horizontal start pulse HST is successively transferred with the clock signals HCK and HCKX, transfer pulses (shift pulses) (1), (2), (3) and (4) are outputted from the shift register. Also the transfer pulses have a pulse width equal to twice the period of the clock signal HCK. On the other hand, while the clock signals DCK1 and DCK2 extracted by the extraction switch set 22 have a period equal to that of the clock signals HCK and HCKX, they have a lower duty ratio. In other words, the pulse width of the clock signals DCK1 and DCK2 is smaller than that of the clock signals HCK and HCKX. It is to be noted that the phases of the clock signals DCK1 and DCK2 are displaced by 180 degrees from each other.

By extracting the clock signal DCK2 with the transfer pulse (1), double sampling pulses (1) are obtained. Then, by extracting the clock signal DCK1 with the transfer pulse (2), double sampling pulses (2) are obtained. Similarly, by extracting the clock signal DCK2 with the transfer pulse (3), double sampling pulses (3) are obtained. Further, by extracting the clock signal DCK1 with the transfer pulse (4), double sampling pulses (4) are obtained.

Each double sampling pulses include a first pulse surrounded by a solid line circle and a second pulse surrounded by a broken line circle in FIG. 2. If attention is paid to the first sampling pulses (1), then the image signal Video1 is precharged with the first pulse first, and then the image signal Video1 is sample held to the same signal line with the succeeding second pulse. The signal line is charged substantially to a level close to the potential of the image signal Video1 by the precharge with the first pulse, and then is sample held correctly to the potential of the image signal Video1 with the succeeding second pulse. When the original potential of the image signal Video1 is sample held, little charge or discharge noise is produced. Similarly, the sampling pulses (2) precharge the image signal Video2 with the first pulse thereof and then sample hold the same image signal Video2 with the second pulse thereof. The sampling pulses (3) precharge the image signal Video3 to a signal line with the first pulse thereof and then sample hold the same image signal Video3 to the same signal line with the second pulse thereof. At this time, the second pulse of the preceding sampling pulses (1) and the first pulse of the succeeding sampling pulses (3) overlap in time with each other. If the sampling pulses (1) and (3) otherwise sample an image signal supplied from the same image line, then interference occurs between them and the correct image signal potentials cannot be sample held. More particularly, while an image signal is sample held with the second pulse of the sampling pulses (1), the same image signal is precharged with the sampling pulses (3). Charge and discharge are caused by the precharge and fluctuate the potential of the image signal. Since the potential fluctuation has an influence on the fluctuation of the potential sample held precedently, correct sample holding cannot be performed. Taking this into consideration, according to the present invention, a preceding sampling switch and a succeeding sampling switch are connected to image lines of different systems from each other thereby to prevent otherwise possible interference in image signals between them.

Figure 3:
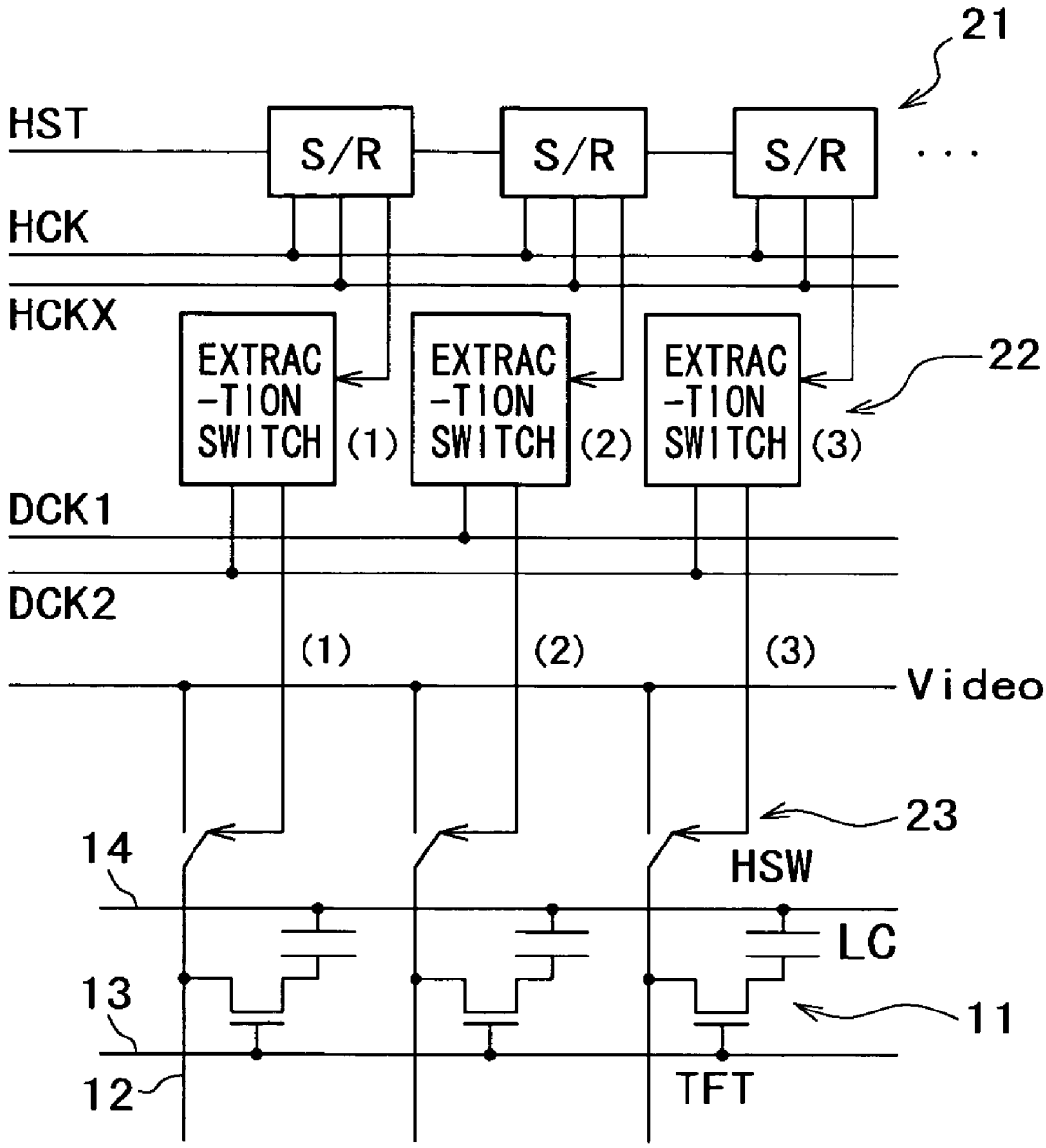
FIG. 3 is a circuit diagram showing a display apparatus as a comparative example.

FIG. 3 is a schematic circuit diagram showing a comparative example of a display apparatus. In FIG. 3, in order to facilitate understanding, like elements to those of the display apparatus of the present invention shown in FIG. 1 are denoted by like reference characters. Referring to FIG. 3, in the comparative example shown, a shift register 21 successively transfers a horizontal start pulse HST in synchronism with clock signals HCK and HCKX to output shift pulses. It is to be noted that the pulse width of the start pulse HST is equal to one period of the clock signal HCK. In other words, the pulse width of the start pulse HST is equal to one half the pulse width of the horizontal start pulse HST used in the embodiment described above. The extraction switch set 22 extracts clock signals DCK1 and DCK2 in response to the shift pulses to produce sampling pulses. Since the width of the shift pulses is smaller, each of the sampling pulses does not become double pulses but includes a one-shot pulse. The sampling switches HSW of the sampling switch set 23 operate to open and close in response to the sampling pulses to sample an image signal Video supplied from an image line of a single system and hold the sampled values of the image signal Video to the signal lines 12.

Figure 4:
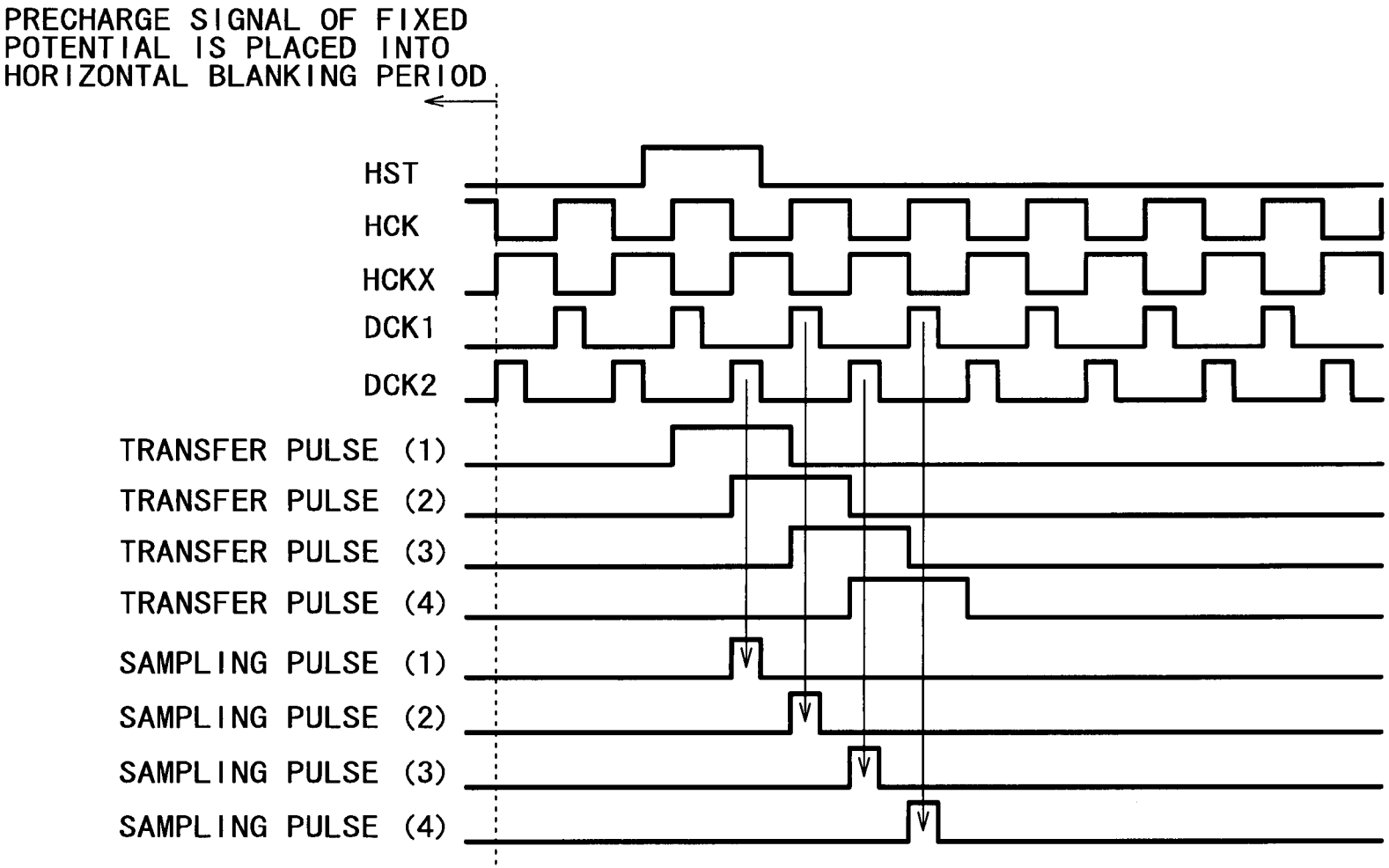
FIG. 4 is a timing chart illustrating operation of the display apparatus of FIG. 3.

FIG. 4 is a timing chart illustrating operation of the comparative example shown in FIG. 3. In FIG. 4, in order to facilitate understanding, like elements to those of the timing chart illustrated in FIG. 2 are denoted by like reference characters. The operation illustrated in FIG. 4 is different from the operation illustrated in FIG. 2 in that the pulse width of the start pulse HST is equal to one period of the clock signal HCK and hence is equal to one half the pulse width of the horizontal start pulse HST used in the present embodiment. Consequently, also the width of the transfer pulses successively outputted from the shift register is equal to one period of the clock signal HCK. The transfer pulses are used to extract the clock signals DCK1 and DCK2 to produce sampling pulses. While the clock signals DCK1 and DCK2 have a pulse width smaller than the pulse width of the clock signal HCK, they have a period equal to that of the clock signal HCK. Accordingly, the pulse width of the transfer pulses is equal to one period of the clock signals DCK1 and DCK2. Consequently, since each of the transfer pulses extracts one pulse of the clock signal DCK1 or DCK2, the sampling pulse obtained finally is a one-shot pulse and is different from double pulses obtained by the present embodiment. Accordingly, in the comparative example, each sampling pulse performs only sample holding of an image signal but cannot perform precharge. Therefore, in the comparative example, before horizontal scanning by the horizontal driving circuit is started, a precharge signal of a fixed potential is precharged at a time to the signal lines. More particularly, within a horizontal blanking period before the horizontal start pulse HST is outputted, an intermediate potential of an intermediate level (gray level) is precharged to the signal lines.

FIGS. 5A and 5B are diagrammatic views illustrating a writing procedure of an image signal into pixels. As seen in FIG. 5A, an image signal is successively written in a unit of a row into the pixels 11 included in the pixel array section 15. Where a liquid crystal cell is used for the pixels 11, 1 H reversal driving is usually performed such that the polarity of the image signal to be written into pixels is reversed after every row. In the example illustrated in FIGS. 5A and 5B, an image signal of the positive polarity is written into the pixels of the odd-numbered rows, and an image signal of the negative polarity is written into the pixels of the even-numbered rows. After an image signal for one field is written line-sequentially, writing into a next field is started and an image signal is written line-sequentially again. In this instance, in addition to 1 H reversal, 1 F (field) reversal is performed. In other words, in the second field, an image signal of the negative polarity is written into odd-numbered rows and an image signal of the positive polarity is written into even-numbered rows. In this manner, the polarity of an image signal reverses after every field.

FIG. 5B is a timing chart schematically illustrating a potential variation of a signal line by sample holding of an image signal. FIG. 5B shows sampling pulses applied to the Nth stage and the N+1th stage. In both cases, charge to the signal line is started at a rising edge of the sampling pulse, and the potential level is held at a falling edge of the sampling pulse. Since the 1 F reversal involves reversal of the polarity as described above, a high suction potential appears at the rising edge of the sampling pulse, and charge and discharge noise is generated. Since the polarity is reversed for every 1 F, the suction potential and the charge and discharge noise are high. Taking this into consideration, in the comparative example, the signal lines are precharged in advance with a precharge signal of an intermediate potential (gray level) so that the potential level of the signal lines reaches a fixed intermediate potential with the same polarity. Consequently, the suction potential and the charge and discharge noise of the signal lines when a sampling pulse is applied actually are suppressed thereby to achieve improvement against a vertical stripe to some degree.

Figure 6A:
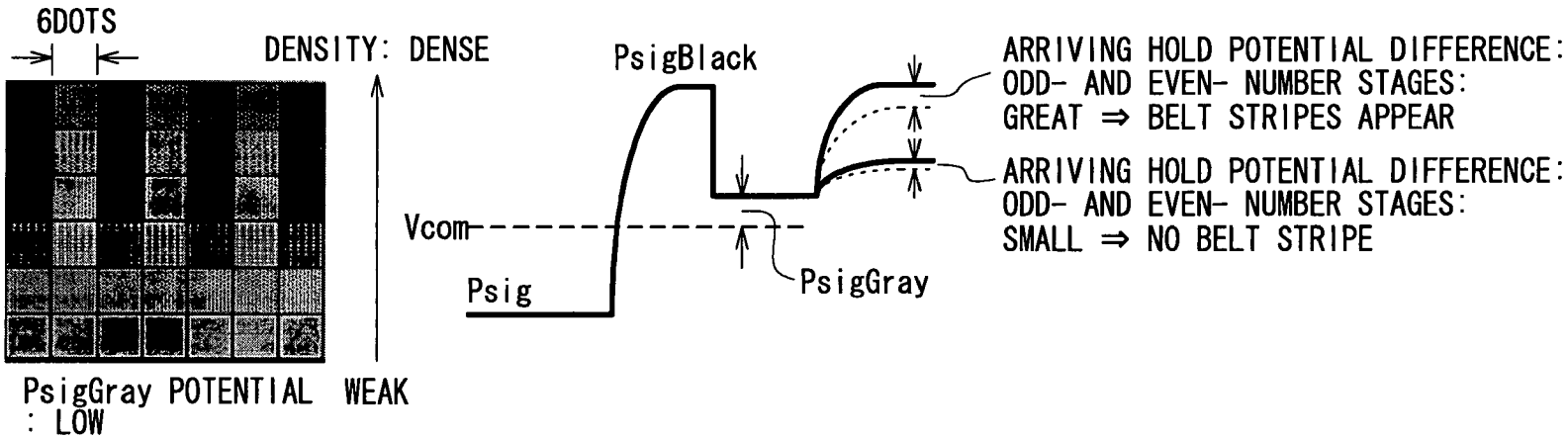
FIGS. 6A and 6B are diagrammatic views illustrating potential variations of an image signal sample held to signal lines.
Figure 6B:
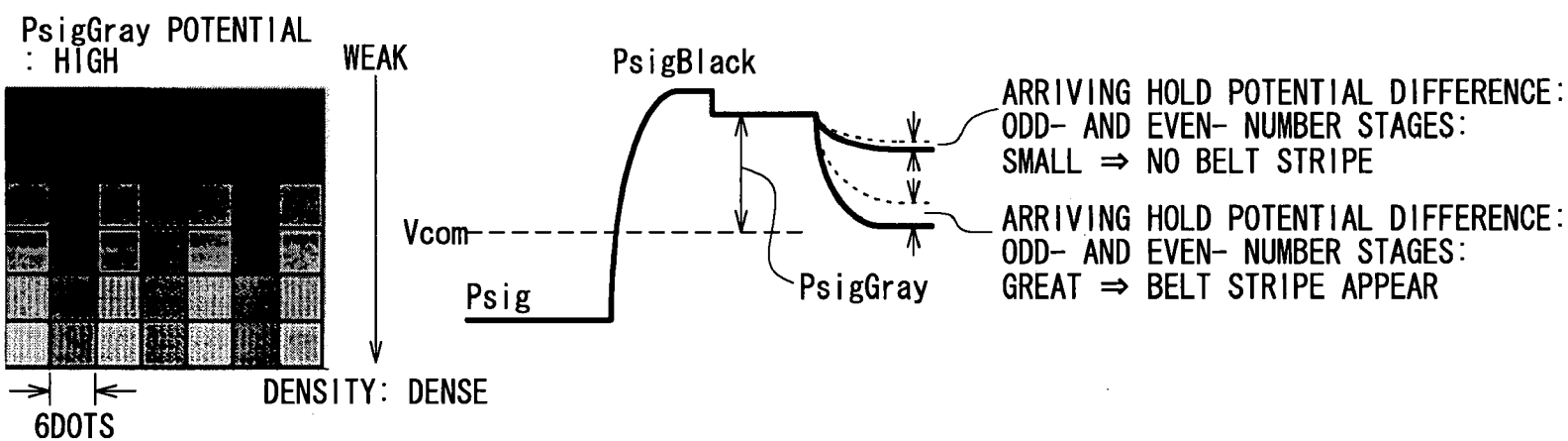
Figure 7:
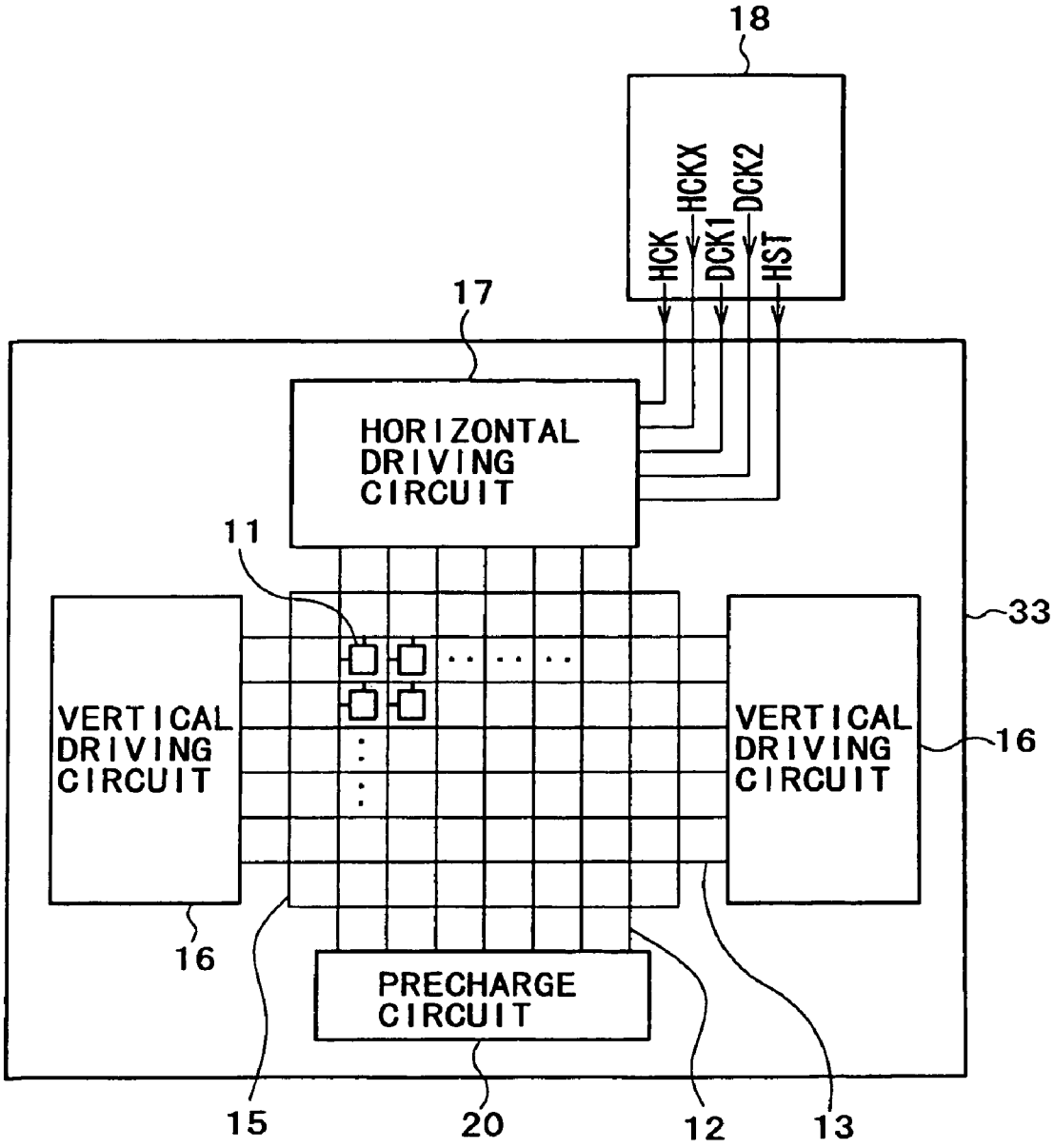
RELATED ART F I G. 7
FIG. 7 is a block diagram showing an example of a related-art display apparatus.

FIGS. 6A and 6B schematically illustrate potential variations where collective precharge adopted by the reference example is performed. In the collective precharge, it is necessary to optimally set the potential of a precharge signal to be applied in advance. However, in the collective precharge, the potential setting cannot be performed for each signal line, and appearance of a defect of a vertical stripe cannot be avoided. For example, in FIG. 6A, the potential of the precharge signal Psig is set to a gray level PsigGray comparatively close to the white level. In this instance, as the image signal to be written approaches the black level away from the gray level PsigGray, a greater arriving hold potential difference appears, and a vertical stripe appears. On the contrary, in a row into which a signal level close to the gray level PsigGray is written, no dispersion occurs in the arriving hold potential difference and no vertical stripe appears. As a result, a more conspicuous vertical stripe appears with a row into which a signal level closer to the black level is written.

FIG. 6B illustrates a potential variation where the potential of the gray level PsigGray is set to a gray level close to the black level. At this time, the arriving hold potential difference decreases as the potential approaches the black level, and a vertical stripe is not conspicuous. On the contrary, the arriving hold potential difference increases as the potential approaches the white level, and a vertical stripe becomes conspicuous. In this manner, even where the gray level PsigGray is set to an optimum value, a region in which a vertical stripe appears is produced depending upon the density of an image to be displayed.

In order to overcome the drawback of the collective precharge system described above, the present invention adopts a sample hold system which uses double sampling pulses. Since the pulse width of the horizontal start pulse HST is set equal to twice the period of the clock signal HCK, also a transfer pulse is transferred while the width thereof is kept. Therefore, a sampling pulse is generated as double pulses. The first one of the double pulses is used for precharge of a signal line of the pertaining stage. Consequently, the potential of the signal line endlessly approaches the potential of the image signal to be written originally. Then, the image signal is written into and held by the signal line of the pertaining stage again with the second pulse included in the double sampling pulses. Consequently, a potential difference by writing from a fixed potential as in the related art does not appear. Further, a suction potential, charge and discharge noise and a held potential difference caused by such potential difference are eliminated, and improvement against a vertical stripe is achieved. Further, the necessity to use a precharge signal of a gray level which is conventionally required is eliminated, and the precharge circuit itself can be removed. Furthermore, since the collective precharge is eliminated, the horizontal blanking period can be reduced.

In summary, according to the present invention, an active matrix display apparatus of the dot-sequential driving type uses double sampling pulses such that a precharge function is provided to the first pulse and a holding function in a unit of a pixel is provided to the second pulse. Where the system just described is used, improvement against a vertical stripe can be achieved without using an existing precharging gray signal. Further, a vertical stripe which appears when an image signal of a potential much different from a gray potential of a precharge signal is written can be removed. As a result, the necessity to use a precharge signal of a gray level is eliminated, and consequently, a relating circuit can be removed. Further, where collective precharge is not performed, the horizontal blanking period can be reduced as much.

While a preferred embodiment of the present invention has been described using specific terms, such description is for illustrative purposes only, and it is to be understood that changes and variations may be made without departing from the spirit or scope of the following claims.

What is claimed is:

1. A display apparatus comprising:

a panel including a plurality of gate lines extending along rows, a plurality of signal lines extending along columns, a plurality of pixels arranged in a matrix at intersecting points at which said gate lines and said signal lines intersect with each other, and a plurality of image lines separated into a plurality of systems for supplying an image signal;

a vertical driving circuit connected to said gate lines for successively selecting the rows of said pixels;

a plurality of sampling switches disposed for connecting said signal lines to said image lines; and a horizontal driving circuit operable in response to a clock signal for successively generating sampling pulses to successively drive said sampling switches so that the image signal is successively written into the pixels of the selected row;

said horizontal driving circuit applying two pulses including a precharging pulse and a sampling pulse to each of said sampling switches such that the corresponding signal line is precharged with the image signal in response to the precharging pulse and then the image signal is sampled to the signal line in response to the sampling pulse;

said image lines being connected such that, when the sampling pulse of two pulses applied to a first one of said sampling switches and the precharging pulse of the two pulses applied to a second one of said sampling switches are in a temporarily overlapping relationship with each other, image lines of a first system are connected to the first sampling switch and image lines of a second system are connected to the second sampling switch thereby to prevent interference of the image signal between the first and second sampling switches due to overlapping of the precharging and sampling pulses.

2. A display apparatus according to claim 1, wherein said horizontal driving circuit includes a shift register for receiving a clock signal having a predetermined period and a start pulse having a pulse width equal to twice the predetermined period and performing a shifting operation of the start pulse in synchronism with the clock signal to successively output shift pulses from individual shift stages thereof and an extraction switch set for extracting a clock signal having the same period as that of the clock signal having a predetermined period in response to the shift pulses successively outputted from said shift register to successively produce the two pulses.

3. A display apparatus according to claim 2, wherein the image line of a first system is connected to those of said sampling switches which belong to a first group in which the sampling switches are disposed at every third place and the image line of a second system is connected to those of said sampling switches displaced by a one-switch distance from the sampling switches of the first group while the image line of a third system is connected to those of the sampling switches of the remaining third group thereby to prevent interference of the image signal between the first sampling switch and the second sampling switch.

4. A driving method of a display apparatus which includes a panel including a plurality of gate lines extending along rows, a plurality of signal lines extending along columns, a plurality of pixels arranged in a matrix at intersecting points at which said gate lines and said signal lines intersect with each other, and a plurality of image lines separated into a plurality of systems for supplying an image signal, a vertical driving circuit connected to said gate lines for successively selecting the rows of said pixels, a plurality of sampling switches disposed for connecting said signal lines to said image lines, said sampling switches including a first sampling switch and a second sampling switch, and a horizontal driving circuit operable in response to a clock signal for successively generating sampling pulses to successively drive said sampling switches so that the image signal is successively written into the pixels of the selected row, comprising:

executing by said horizontal driving circuit of applying two pulses including a precharging pulse and a sampling pulse to each of said sampling switches such that the corresponding signal line is precharged with the image signal in response to the precharging pulse and then the image signal is sampled to the signal line in response to the sampling pulse; and connecting, where the sampling pulse applied to the first sampling switch and the precharging pulse applied to the second sampling switch are in a temporarily overlapping relationship with each other, image lines of a first system to the first sampling switch and image lines of a second system to the second sampling switch thereby to prevent interference of the image signal between the two sampling switches because of overlapping pulses.

5. A display apparatus comprising:

a panel configured to include a plurality of gate lines extending along rows, a plurality of signal lines extending along columns, a plurality of pixels arranged in a matrix at intersecting points at which said gate lines and said signal lines intersect with each other, and a plurality of image lines separated into a plurality of systems for supplying an image signal;

a vertical driving circuit configured to connect to said gate lines and successively select the rows of said pixels;

a plurality of sampling switches configured to connect said signal lines to said image lines, said plurality of sampling switches including a first sampling switch and a second sampling switch; and a horizontal driving circuit configured to generate, in response to a clock signal, sampling pulses to successively drive said sampling switches so that the image signal is successively written into the pixels of the selected row;

said horizontal driving circuit configured to apply two pulses including a precharging pulse and a sampling pulse to each of said sampling switches such that the corresponding signal line is precharged with the image signal in response to the precharging pulse and then the image signal is sampled to the signal line in response to the sampling pulse;

said image lines being connected such that, when the sampling pulse of two pulses applied to the first sampling switch and the precharging pulse of two pulses applied to the second sampling switch are in a temporally overlapping relationship with each other, image lines of a first system are connected to the first sampling switch and image lines of a second system are connected to the second sampling switch thereby to prevent interference of the image signal between the first sampling switch and the second sampling switch due to overlapping of the precharging and sampling pulses.

* * * * *